United States Patent [19]

Aimett

[11] 4,254,507

[45] Mar. 10, 1981

[54] VERTICAL STRIP FURRIERY ARTICLE

[76] Inventor: Paolo Aimett, Via Pietro Verri, 10, 20121 Milano, Italy

[21] Appl. No.: 17,460

[22] Filed: Mar. 5, 1979

[30] Foreign Application Priority Data

Nov. 15, 1978 [IT] Italy ..... 29831 A/78

[51] Int. Cl.[3] ..... A41D 5/00

[52] U.S. Cl. ..... 2/65

[58] Field of Search ..... 2/65; 428/88; 69/23, 69/22, 19; 223/28

[56] References Cited

U.S. PATENT DOCUMENTS

| | | | |
|---|---|---|---|
| 2,703,485 | 3/1955 | Wolff | 428/88 |
| 3,074,073 | 1/1963 | Hak | 2/65 |

FOREIGN PATENT DOCUMENTS

| | | | |
|---|---|---|---|
| 641923 | 2/1937 | Fed. Rep. of Germany | 69/22 |

*Primary Examiner*—Doris L. Troutman

*Attorney, Agent, or Firm*—Bucknam and Archer

[57] ABSTRACT

Fur articles are described which consist of a plurality of alternating fur and cloth vertical parallel strips connected to one another, wherein each cloth strip is turned over on itself along the longitudinal axis thereby being double. The two cloth half-strips may be coupled to one another by a second fur strip or interposing a second fur strip. The second fur strip, interposed between the two cloth half-strips, has the hairy surface turned towards the interior or the exterior of the obtained article.

6 Claims, 5 Drawing Figures

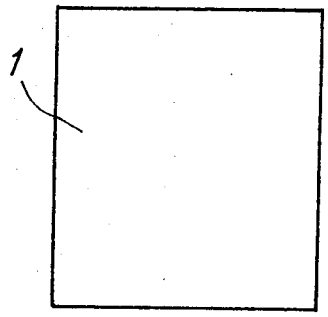
Fig. 1
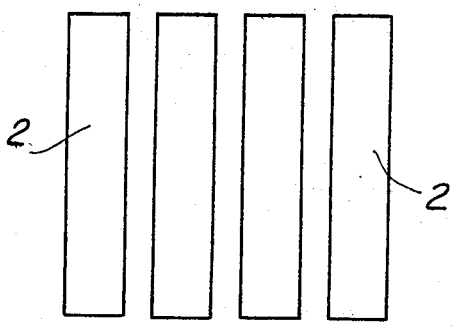
Fig. 2
Fig. 4
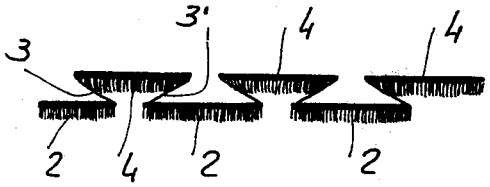
Fig. 3
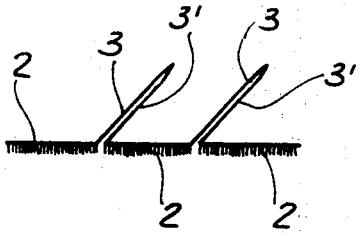
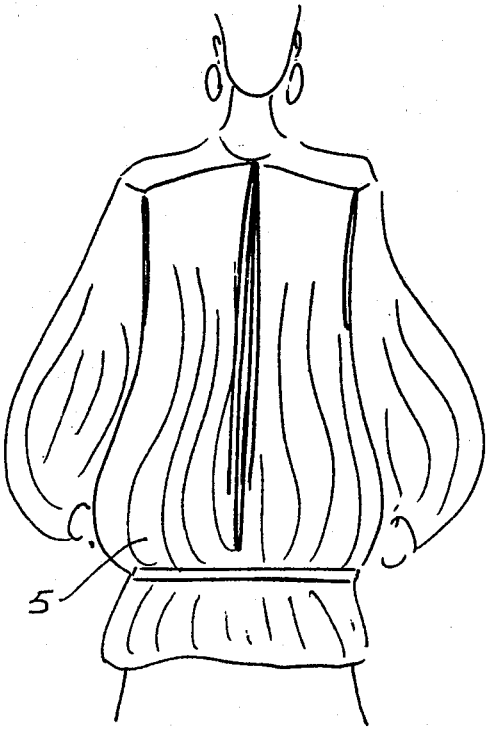
Fig. 5

VERTICAL STRIP FURRIERY ARTICLE

The present invention relates to a fur article, formed by fur strips or bands, coupled to one another and intercalated by strips of cloth or other like material, and to the method of manufacture.

As it is known, the fur articles are generally obtained by squaring the pelts, suitably tanned, of particular animals and connecting the squared pelts in such a way that the edges thereof be closely flanked.

Alternatively, the pelts may be preliminarly reduced to strips, of suitable width, which are then connected to one another according to the indicated system.

These methods of manufacture, however, provide substantially conventional fur articles, that is articles having a rather close-fitting structure.

The object of the present invention is to provide a fur article having new and special aesthetics and wearability characteristics, and moreover a suitably enriched structure.

The Applicant has found that this object is achieved by fur articles consisting of a plurality of alternate fur and cloth vertical, parallel strips, connected to one another, wherein each cloth strip is turned over on itself along the longitudinal axis thereof thereby being double.

The cloth strips may also be made of shammy-leather, or other like material.

Preferably each cloth strip may consist of two half-strips stitched along the longitudinal edge in such a way as to be normally superimposed, the half-strips being connected at the rear of the fur strips thereby coupled.

In use, the fur article according to the invention is capable of becoming larger or extending, due to the person movement, alternatively rotating on itself, as a pleated article.

Alternatively, the cloth half-strips may be connected to one another by a further fur strip or interposing said further fur strip.

In this way is obtained a fur article which is substantially formed by a double fur strip structure, one in the interior of the other, connected or coupled by cloth strips which are normally concealed between the two structures of fur strips.

The fur strips forming the inner structure, if desired, may have the hairy surface outwardly or inwardly turned. By exploiting this possibility, the inner structure may also be formed by pelts of different animals, with the possibility of turning over the furriery article thus obtaining a so-called "double-face" fur.

The characteristics of functional, aesthetical and constructional nature of the fur article according to the invention will become more apparent from the following description, in which reference is made to the figures of the accompanying drawing, illustrating an exemplary and not limitative preferred embodiment of the present invention, and where:

FIG. 1 schematically illustrates a fur pelt, as tanned and squared;

FIG. 2 illustrates the pelt of FIG. 1 cut according to suitable width parallel strips;

FIG. 3 illustrates the cross-section of the structure obtained coupling the fur strips of FIG. 2 to double cloth strips;

FIG. 4 illustrates, in a schematic form, a cross-section of a second structure as obtained by coupling the fur strips of FIG. 2 to cloth strips jointed, at the other free longitudinal end thereof, by further fur strips; and FIG. 5 illustrates, by an indicative and schematic example, a fur article obtained by the structure of FIGS. 3 and 4.

Referring to the aforesaid figures, from the pelt 1 as preliminarly squared, are cut a plurality of longitudinal parallel strips 2.

The pelt strips 2 are jointed to one another, at the longitudinal edges thereof, by means of double strips 3 and 3' of cloth, or shammy-leather or other like material.

The double cloth strips 3 and 3' may consist of two half-strips stitched to one another along one edge thereof, thereby adjoining continuously one another.

Alternatively, the cloth half-strips 3 and 3' may be coupled (see FIG. 4) by interposing a further fur strip 4. The strips 4 may consist of the same pelt as the strips 2 or of a different type of pelt.

Moreover, the hairy surface of the strips 4 may be turned both outwardly and inwardly of the article 5 to be formed, and accordingly in the same direction or in an opposite direction with respect to the strips 2.

From the above description and the examination of the figures are self evident the originality and the particular wearability characteristics of the fur article according to the invention.

Modifications and changes may be carried out in the fur articles formed according to the present invention, said modifications and changes falling within the teachings of the invention and do not depart from the scope thereof.

I claim:

1. A pleated fur article consisting of a plurality of vertical strips of fur, each one of said fur strips, alternatively connected with strips of cloth or shammy leather, the strips of cloth or shammy leather being folded back under the fur strips to form the pleats.

2. A fur article according to claim 1 wherein each strip of cloth or shammy leather consists of two half-strips stitched to one another along the longitudinal axis thereof, each half-strip being superimposed to the other.

3. A fur article according to claim 1 wherein two half-strips of cloth or shammy leather are coupled to one another by a second fur strip.

4. A fur article according to claim 3 wherein the second fur strip, interposed between the two half-strips of cloth or shammy leather, has a hairy surface thereof turned towards the interior of the fur article.

5. A fur article according to claim 3, wherein the second fur strip, interposed between the half-strips of cloth or shammy leather, has a hairy surface thereof turned towards the exterior of the fur article.

6. A fur article according to claim 3, wherein said second fur strip is different from that of the first strip.

* * * * *